US011208727B2

(12) United States Patent
Malloy et al.

(10) Patent No.: US 11,208,727 B2
(45) Date of Patent: Dec. 28, 2021

(54) SCALE CONDITIONING PROCESS FOR ADVANCED HIGH STRENGTH CARBON STEEL ALLOYS

(71) Applicant: KOLENE CORPORATION, Detroit, MI (US)

(72) Inventors: James C. Malloy, Ferndale, MI (US); Louis Pignotti, Plymouth, MI (US)

(73) Assignee: KOLENE CORPORATION, Detroit, MI (US)

( * ) Notice: Subject to any disclaimer, the term of this patent is extended or adjusted under 35 U.S.C. 154(b) by 436 days.

(21) Appl. No.: 15/746,053

(22) PCT Filed: Jul. 22, 2016

(86) PCT No.: PCT/US2016/043447

§ 371 (c)(1),
(2) Date: Jan. 19, 2018

(87) PCT Pub. No.: WO2017/015522

PCT Pub. Date: Jan. 26, 2017

(65) Prior Publication Data

US 2018/0202052 A1 Jul. 19, 2018

Related U.S. Application Data

(60) Provisional application No. 62/195,366, filed on Jul. 22, 2015.

(51) Int. Cl.
*C23G 1/32* (2006.01)
*C23G 1/08* (2006.01)
(Continued)

(52) U.S. Cl.
CPC ..... *C23G 1/32* (2013.01); *B08B 3/041* (2013.01); *B08B 3/08* (2013.01); *B08B 3/10* (2013.01);
(Continued)

(58) Field of Classification Search
None
See application file for complete search history.

(56) References Cited

U.S. PATENT DOCUMENTS 2,635,063 A * 4/1953 Dunlevy ..... C23G 1/32 134/15
3,625,900 A * 12/1971 Shoemaker ..... C23G 1/28 510/272
(Continued)

FOREIGN PATENT DOCUMENTS

BY 9384 C1 6/2007
CN 1401015 A 3/2003
(Continued)

OTHER PUBLICATIONS

Russian Patent Office International Preliminary Report on Patentability and Written Opinion dated Jan. 23, 2018 re PCT Application No. PCT/US/2016/043447 of Kolene Corporation.
(Continued)

*Primary Examiner* — Cristi J Tate-Sims
(74) *Attorney, Agent, or Firm* — Patrick J. Daugherty; Daugherty & Del Zoppo, Co. LPA

(57) ABSTRACT

Aspects treat and remove a layer of scale comprising iron oxide and alloying elements oxides that is formed on an advanced high strength metal surface comprising at least two (2) percent by weight of alloy. A first conditioning process compromises structural integrity of or removes iron oxide within the scale layer to expose the alloy oxide to chemical engagement with a disposed aqueous alkali salt solution that is heated to transforming one or more alkali salts within the disposed solution into a quasi-molten form. The alloy oxide is oxidized via reaction with the solution quasi molten alkali salt(s) and water, forming one or more water soluble alkali alloy compounds. A water rinse dissolves and rinses the water soluble compound(s) from the
(Continued)

steel product surface of the advanced high strength, leaving a film of iron oxide on the surface that is removed via a final pickling process.

21 Claims, 3 Drawing Sheets

(51) Int. Cl.

| | |
|---|---|
| ***C23G 3/02*** | (2006.01) |
| ***B08B 3/04*** | (2006.01) |
| ***B08B 3/08*** | (2006.01) |
| ***B08B 3/10*** | (2006.01) |
| ***B08B 7/00*** | (2006.01) |
| ***C23C 8/42*** | (2006.01) |
| ***C23G 3/00*** | (2006.01) |

(52) U.S. Cl.
CPC ..... *B08B 7/0071* (2013.01); *C23C 8/42* (2013.01); *C23G 1/08* (2013.01); *C23G 1/081* (2013.01); *C23G 3/00* (2013.01); *C23G 3/02* (2013.01)

(56) References Cited

U.S. PATENT DOCUMENTS

| | | | | | |
|---|---|---|---|---|---|
| 3,951,681 | A * | 4/1976 | Shoemaker | C23G 1/28 | 134/2 |
| 4,264,418 | A * | 4/1981 | Wood | C25F 1/00 | 134/3 |
| 4,455,251 | A * | 6/1984 | Wood | C23G 1/28 | 134/10 |
| 5,108,544 | A * | 4/1992 | Hakansson | C23G 1/04 | 134/3 |
| 5,272,798 | A * | 12/1993 | Cole | C23G 1/28 | 29/81.08 |
| 5,377,398 | A * | 1/1995 | Bessey | C23G 1/28 | 29/81.07 |
| 5,505,786 | A * | 4/1996 | Cole | C23G 1/28 | 134/2 |
| 5,606,787 | A * | 3/1997 | McGuire | B21B 3/02 | 29/81.03 |
| 6,450,183 | B1 * | 9/2002 | Cole | C23G 1/14 | 134/2 |
| 6,851,434 | B2 * | 2/2005 | Cole | C23G 1/14 | 134/102.1 |
| 7,151,080 | B2 * | 12/2006 | Dostie | C11D 1/72 | 510/176 |
| 10,006,129 | B2 * | 6/2018 | Malloy | C23G 3/02 | |
| 2002/0148484 | A1 * | 10/2002 | Cole | C23G 1/14 | 134/2 |
| 2005/0233936 | A1 * | 10/2005 | Dostie | C11D 1/72 | 510/421 |
| 2010/0095980 | A1 | 4/2010 | Uemura et al. | | |
| 2010/0269854 | A1 | 10/2010 | Barbieri et al. | | |
| 2013/0029054 | A1 * | 1/2013 | Malloy | C23G 3/023 | 427/444 |
| 2016/0289847 | A1 * | 10/2016 | Malloy | C23G 3/02 | |

FOREIGN PATENT DOCUMENTS

| | | | |
|---|---|---|---|
| CN | 102762771 | A | 10/2012 |
| CN | 103785696 | A | 5/2014 |
| CN | 104388652 | A | 3/2015 |
| DE | 60122742 | T2 | 8/2007 |
| JP | BS53034167 | B | 9/1978 |
| JP | S61153291 | A | 7/1986 |
| JP | H11172478 | A | 6/1999 |
| SU | 1093731 | A | 5/1984 |

OTHER PUBLICATIONS

Translation of Japanese Patent Office Office Action letter dated Aug. 4, 2020 and issued in related application.

Russian Patent Office International Search Report dated Sep. 22, 2016 re PCT Application No. PCT/US/2016/043447 of Kolene Corporation.

Chinese Office action with search report dated Apr. 12, 2019 re Chinese application of Kolene Corporation, Serial No. 201680047441.4, filed Feb. 11, 2018 (English translation).

* cited by examiner

SCALE CONDITIONING PROCESS FOR ADVANCED HIGH STRENGTH CARBON STEEL ALLOYS

TECHNICAL FIELD

Embodiments of the present invention relate generally to the chemical modification of surface scales of iron and alloy oxides formed in the production of high strength carbon steel alloys, as well as to the general conditioning of scales formed on surfaces metal with high alloy percentages, wherein the scale is composed of mixtures of iron and alloy oxide.

BACKGROUND OF THE INVENTION

In a typical hot strip mill, slabs of carbon steel are initially reheated to about 2500 degrees Fahrenheit (° F.) (1371 degrees Celsius (° C.)) in a reheat furnace to make them more malleable. The now-hot slab is conveyed to a high pressure water jet descaling station to remove the heavy scale formed during slab reheat. The slab then progresses through a series of roughing and finishing stands. These typically comprise vertically stacked working rolls that engage and apply pressure to top and bottom sides of the slab, sometimes in combination with water sprays, resulting in progressive reductions in slab thickness and temperature, and in increasing elongation of the slab into a steel strip.

Generally, the roughing and finishing stands are synchronized to compensate for ever-increasing speeds of the strip as the slab material is progressively elongated and reduced in gage (and temperature) and to form final strip width and thickness dimensions, for example to produce a specified thickness, gage and/or other dimension. The final strip is coiled by a coiler, generally at a high rate of speed (for example, around 30 miles per hour, though other speeds may be practiced) after conveyance along the last rolling stand area of a run-out table. The final coiling temperature of the strip is generally reduced in a run-out table cooling area prior to coiling, conventionally through use of water sprays, but remains at an elevated temperature, commonly between 1100° F. (593° C.) and 1450° F. (788° C.).

During this final hot rolling process, oxygen from the atmosphere reacts with iron and alloying elements present in the surface of the steel to form a scale or crust on the strip surface that is made up of a mixture of iron and alloy oxides. The presence of this complex oxide scale on the surface of the steel is generally objectionable in subsequent steel processing (for example in cold-rolling, welding, annealing, metallic coatings, painting and other coating processes). Thus, the scale oxides must generally be removed from the metal strip through a post-hot rolling process, such as pickling.

Carbon steel products often incorporate small amounts of alloying elements to increase strength and provide better mechanical properties or greater resistance to corrosion, relative to plain carbon steel. Illustrative but not limiting or exhaustive examples of alloying elements commonly used in high strength low alloy (HSLA) steels include manganese, silicon, copper, nickel, niobium, nitrogen, vanadium, chromium, molybdenum, titanium, calcium, boron, rare earth elements, and zirconium. The alloy elements may disperse as alloy carbides in a ferrite matrix that increases material strength via refining grain size, relative to the typical ferrite-pearlite aggregate carbon steel microstructures of non-alloyed carbon steels.

Alloy steels are generally produced by converting molten steel generated by steel-making furnaces into sheet products via casting, hot rolling and finishing processes. During hot rolling or subsequent heat-treating processes, oxygen from the atmosphere reacts with iron and alloy components in the surface of the high strength steel to form mixtures of surface scales that include iron and other oxides. The presence of this oxide mixture scale on the surface of the steel is generally objectionable in subsequent steel processing.

BRIEF SUMMARY

In one aspect of the present invention, a method for treating and removing a layer of scale comprising iron oxide and alloying elements oxides that is formed on an advanced high strength metal surface includes conditioning, via a first conditioning process, a scale layer formed on a surface of an advanced high strength steel product via reaction with oxygen during a hot rolling process, wherein the advanced high strength steel product comprises at least two (2) percent by weight of alloy, and the scale layer comprises iron oxide and alloy oxide that is formed by oxidation of the alloy. The first conditioning process compromises a structural integrity of the iron oxide within the scale layer or removes iron oxide components from the scale layer, to thereby expose the alloy oxide to chemical engagement via disposition. An aqueous alkali salt solution is disposed onto the scale layer conditioned via the first conditioning process, and thereby into engagement with the alloy oxide that is exposed to chemical engagement. The disposed aqueous alkali salt solution is heated to at least 288 degrees Celsius (550 degrees Fahrenheit), the heating transforming one or more alkali salts within the disposed aqueous alkali salt solution into a quasi-molten form. The alloy oxide is oxidized via reaction with the quasi molten form of the alkali salt(s) and with water within the disposed aqueous alkali salt solution, forming one or more water soluble alkali alloy compounds. The surface of the advanced high strength steel product is rinsed with water, the water dissolving the water soluble alkali alloy compound(s) and rinsing the dissolved compound(s) from the surface of the advanced high strength steel product, thereby leaving a film of iron oxide on the surface of the advanced high strength steel product, that is removed via a final pickling process.

In another aspect, a system has a first conditioning process apparatus that conditions a scale layer formed on a surface of an advanced high strength steel product via reaction with oxygen during a hot rolling process, wherein the advanced high strength steel product comprises at least two (2) percent by weight of alloy, and the scale layer comprises iron oxide and alloy oxide that is formed by oxidation of the alloy. The first conditioning process compromises a structural integrity of the iron oxide within the scale layer or removes iron oxide components from the scale layer, to thereby expose the alloy oxide to chemical engagement via disposition. A salt solution disposition station disposes an aqueous alkali salt solution onto the scale layer conditioned via the first conditioning process, and thereby into engagement with the alloy oxide that is exposed to chemical engagement. A heating apparatus heats the disposed aqueous alkali salt solution to at least 288 degrees Celsius (550 degrees Fahrenheit), the heating transforming one or more alkali salts within the disposed aqueous alkali salt solution into a quasi-molten form, and wherein the alloy oxide is oxidized via reaction with the quasi molten form of the alkali salt(s) and with water within the disposed aqueous alkali salt solution, forming one or more water soluble alkali alloy compounds. A water rinsing station rinses the surface of the advanced high strength steel product with water, the water dissolving the water soluble alkali alloy compound(s) and rinsing the dissolved compound(s) from the surface of the advanced high strength steel product, thereby leaving a film of iron oxide on the surface of the advanced high strength steel product, that is removed via a final pickling process performed in a final pickling process apparatus.

DETAILED DESCRIPTION OF THE INVENTION

Figure 1:
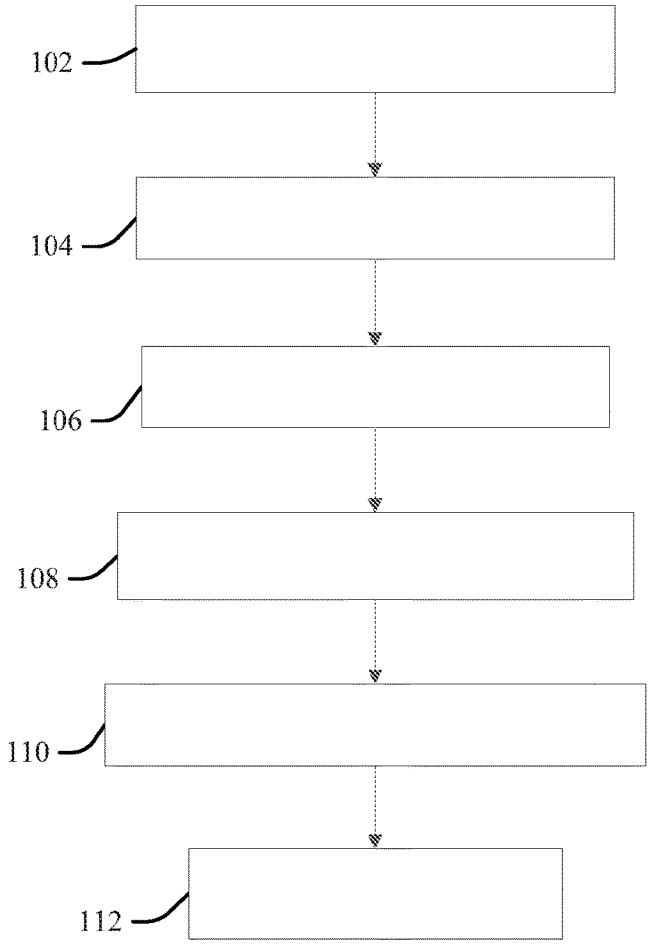
FIG. 1 is a block diagrammatic view of an embodiment of a method according to the present invention for treating and removing a layer of scale comprising iron oxide and alloying element oxides that is formed on an advanced high strength metal surface.

Oxide scales formed during hot rolling metal strips may be removed from metal surfaces through a variety of processes. Mechanical scale breaking processes include bending, stretching or flexing of the strip to physically break the integrity of the scale structure, including forming micro channels for reactive liquids to penetrate into the scale. Various mechanical blast techniques are also used to abrade away the oxide layers. Chemical processes react with and change the chemical structure of the scale components, again in order to disrupt their attachment to the underlying metal surface, and include acid pickling, acid cleaning and disposition of molten alkali salt compounds.

The use of mineral acid pickling baths of varying compositions and under varying conditions have proven to be both effective and economical for the removal of iron oxide scale from conventional carbon steel strips that also incorporate modest amounts of fractional percentages of other oxides from the presence of alloy additives (for example, the alloy additives may total less than one (1) percent of the metal strip components). The oxide scales formed on a hot mill during hot rolling of such conventional grades are not significantly influenced by the presence of the alloy components with respect to reactivity with conventional pickling practices, and they are generally amenable to efficient removal by conventional mechanical and/or chemical (pickling) techniques.

Advanced high strength steels are primarily iron and have relative percentages of alloying elements that are substantially higher than that found in conventional and historical alloyed carbon steels, for example a total alloying element content of more than two percent of the metal strip components, with significantly higher levels envisioned in future alloy development. The higher alloy percentages enable stronger structural characteristics, but pose significant pickling challenges.

The complex oxides formed during hot rolling of advanced high strength steels having significant amounts of alloying elements (for example, two percent and higher) and pose unique challenges for their removal. Not only are the oxide thicknesses substantially greater than those formed on conventional carbon steels with relatively lower amounts of alloying elements, multiple metallic oxide compositions are present, each with distinct chemical reactivities (or stabilities). Rather than relying on simple mineral acid pickling process, such as a bath of hydrochloric acid solutions to remove iron oxides, more advanced and reactive acid mixtures are proposed or utilized, but they are problematic in practice. Acid baths such as sulfuric and nitric acid solutions that are augmented by electrolytic activation to provide higher chemical activity to better remove tenacious and refractory high alloy oxides are commonly used when pickling stainless steels. Mixed acid solutions such as nitric plus hydrofluoric acids are also used where undercutting of the tenacious scales is required for scale removal, but again are usually limited to high alloy stainless steels and super alloys.

Untoward results such as generation of nitrogen oxide gas with nitric acid pickling, and temperature control difficulties from the exothermic nature of the reaction between the acid and iron, limit the applicability and efficacy of such prior art approaches with respect to removal of the complex oxides formed during the hot rolling of advanced high strength steels. In one aspect, the effects of more aggressive pickling solutions may impact the underlying steel surface to an unacceptable degree.

The efficacy of a given process in removing oxide scales from a metal surface is also dependent upon the presence of particular oxides, or blends of oxides, within the scale. Oxide scale layers formed on the surface of AHSS via reaction with atmospheric oxygen during hot rolling processes generate surface oxide scale structures that comprise mixtures of iron and alloy oxides. Due to differences in reactivity with the iron and alloy oxides in such scale, as well as to differences in behavior and characteristics of their respective reactivity products, conventional pickling line processes generally fail to remove such oxide mixture scales in an efficient or satisfactory manner Greatly reduced line speeds and/or multiple passes through a conventional pickling line may be required to produce surface finishes that, at times, are only marginally acceptable. For example, while some pickling lines achieve satisfactory scale condition results on conventional carbon steels running sheets of steel through the process at between about 200 to about 300 meters/minute, to satisfactorily treat advanced high strength steels via the same process the speed must be slowed down to run at a fraction of the conventional line speed, which may be unacceptably slow to generate acceptable throughput in a given production process. Further, though the steel surface coming off such a conventional pickle line at the slower speeds may visually appear to be clean and acceptable, residual oxide components may remain to an extent such that the strip surface will in fact fail to accept application of some metallic coatings such as zinc and aluminum.

Moreover, the scale layer structures formed by mixtures of iron and alloy oxides, and their relative distributions within the scale layer, may vary greatly as a function of coiling temperature or other parameters. In one exemplary AHSS formulation hot coiling at a first, higher temperature causes the formation of a hard, bright, shiny metallic scale that has a generally continuous distribution of iron and alloy oxides throughout the layer. Hot coiling the same AHSS formulation at a different, second and lower temperature produces a scale layer that has instead a porous, rusty outer iron oxide surface layer that is disposed above an underlying layer formed predominantly with alloy oxides, wherein the metallic top layer created by the higher temperature is absent.

The depth dimensions of the different scale structure may also vary, with one substantially less than the other. Thus, due to differences in the structure and composition of the scales, a given conditioning process found effective and economical for application to the scale formed via hot rolling at a higher temperature may fail to provide satisfactory results for a different scale formed on the same AHSS via hot rolling at a lower temperature, and another, different conditioning process found effective and economical for application to the scale via hot rolling at the lower temperature may fail to provide satisfactory results for scale formed on the same AHSS via hot rolling at the higher temperature.

Conditioning processes vary greatly in their efficacy with respect the different iron and alloy oxides, and to the different scale structures formed thereby. This presents problems in selecting and executing an appropriate oxide removal process in order to efficiently and effectively remove complex mixed oxide scales to a satisfactory degree. Selecting one conventional process over another may result in significant increases in energy or chemical requirements, operating expenses or adverse impacts on production throughput. Even then, due to differences in efficacy relative to the iron and alloy oxides or scale structures defined by the same, the selected conventional process may still present poor surface quality, deleterious productivity limitations or undesirable hazardous material exposures.

FIG. 1 illustrates a method according to the present invention for treating and removing a layer of scale comprising iron oxide and one or more subjacent alloy oxides and formed on a surface of an advanced high strength steel product metal during hot rolling. More particularly, the advanced high strength steel product comprises at least a total of two (2) percent by weight of alloy, wherein the alloy may include multiple (two or more) and different alloy elements. The scale layer is a layer of oxides formed via a surface reaction of iron and the alloy(s) within the steel strip with atmospheric oxygen during hot rolling of the steel product. Said reaction is an oxidization that generates the scale layer as a mixture of oxides of the iron and the alloying element(s).

At 102 a first conditioning process conditions the scale layer, compromising a structural integrity of the iron oxide within the scale layer and thereby exposing the residual alloy oxide(s) to chemical engagement via disposition onto the scale layer, either through the compromised structural integrity of the iron oxide and/or via removal of iron oxide components from the scale layer.

At 104 an aqueous alkali salt solution is disposed onto the scale layer that is conditioned via the first conditioning process, and thereby into engagement with the residual alloy oxide(s) exposed to chemical engagement (through the compromised structural integrity of the iron oxide, or as exposed by removal of the iron oxide components from the scale layer).

At 106 the disposed aqueous alkali salt solution is heated to at least 288 degrees Celsius (550 degrees Fahrenheit), the heating melting at least one alkali salt within the disposed aqueous alkali salt solution into a quasi-molten form. The term "quasi molten" will be understood to describe a transitional state of a form of the disposed alkali salts from an initial water solution state to a very concentrated water solution state, then to a super hydrated semi-molten condition, and lastly to an anhydrous molten state.

At 108 water and the quasi molten form of the alkali salt(s) within the disposed aqueous alkali salt solution react with (oxidize) each of the alloy oxide(s) to form respective water soluble alkali alloy compound(s).

At 110 the surface of the advanced high strength steel product is rinsed with water, the water dissolving the water soluble alkali alloy compound(s) and rinsing the dissolved compound(s) from the surface of the advanced high strength steel product. The rinsing leaves a film of iron oxide on the surface of the advanced high strength steel product.

At 112 the surface of the advanced high strength steel product is pickled via a final conditioning (pickling) process to remove the iron oxide film layer from the surface of the advanced high strength steel product.

Fused or molten salt descaling scale conditioning provides one modality for tenacious or refractory scales such as chromium oxide, manganese oxide, silicon dioxide, and similar oxides. Aspects rely on highly-reactive alkali salt formations, namely a molten salt treatment reaction that occurs in combination with the water present in the solution that is disposed on the metal surface at 104 (FIG. 1) and heated at 106. This process quickly removes surface scale and leaves a uniformly reactive surface that responds well to mild acid pickling in a final pickling step (for example, at 112).

The molten salt treatment conditioning (for example, at 106 and 108) comprises reactions that are essentially carried out in two steps: the first step involves oxidation of the alloy oxide, and the second step is the dissolution of the high valence oxide as an alkali:metal compound.

When iron oxide scale is contacted with the alkaline molten salt, only a single step reaction takes place: surface scale oxidation. Iron oxide is virtually insoluble in fused or molten salt. In fact, molten salt bath furnaces are commonly constructed of thick steel plate, and when properly maintained, have service lives of twenty to thirty years or more even when continuously exposed to caustic alkalis at temperatures of 900° F. (482° C.).

The complex oxides formed during hot rolling of advanced high strength steels pose unique challenges for their removal. Not only are the oxide thicknesses substantially greater than conventional carbon steels, multiple metallic oxide compositions are present, each with distinct chemical reactivates or stabilities. Attempts to descale these alloys using conventional hot hydrochloric acid pickling have not been successful due to one or more of the following: poor cleaning, excessive metal loss, and/or low pickling line productivity. While somewhat successful on some alloy compositions, conventional chemical scale conditioning reactions are generally hindered by a significant iron oxide or metallic "skin" or outermost oxide layer that is present on some hot rolled advanced high strength steels. For molten salt conditioning to be effective, access to the underlying alloying element oxides must be established.

In some aspects, the first conditioning process at 102 is a mechanical scale breaking process that cracks or otherwise compromises the structural integrity of the scale layer, and in particular of the iron oxide components, thereby exposing the alloy oxide(s) to chemical engagement via disposition onto the scale layer through the compromised structural integrity of the iron oxide, facilitating salt contact to the underlying alloy oxides. Abrasive blasting with a wide range of media and propulsion techniques may be used, and illustrative but not limiting or exhaustive examples of blasting media include metallic shot and ceramics. Brushing, bending, stretching or flexing the strip to physically break the integrity of the scale structure may also be performed, to generate micro-cracks in the oxide scale that provide fluid pathways to the scale-metal interface. This assists in allowing undercutting actions by reactions with subsequent chemical dispositions, where base metal dissolution is used to dislodge the oxide layer rather than dissolving the oxide layer proper.

In other aspects, the first conditioning process at 102 is a first acidic pickling pretreatment that is performed prior to the molten salt scale conditioning, exposing the alloy oxide(s) to chemical engagement via disposition onto the scale layer via removal of iron oxide components from the scale layer. Pickling is generally more selective in removing conventional iron oxide scale components than mechanical options, but is only marginally reactive with the more refractory alloying element oxides. Once the iron oxide layer has been dissolved by the pickling process, subsequent exposure to molten salt conditioning can proceed with the formation of complex alkali compounds.

Aspects of pickling acids used in the first conditioning process at 102 comprise one or more of hydrochloric and sulfuric acids. These acids react with the iron oxide within the scale layer to form first reaction products: elemental carbon, water, iron sulfate from reacting with the sulfuric acid, and iron chloride from reacting with the hydrochloric acid.

Aspects also incorporate a water rinsing step prior to the disposition of the aqueous alkali salt solution at 104, which rinses the water, iron sulfate and iron chloride reaction products from the scale layer, leaving a porous, sponge-like outer scale surface layer structure comprising substantially a layer of the remaining elemental carbon.

Figure 3:
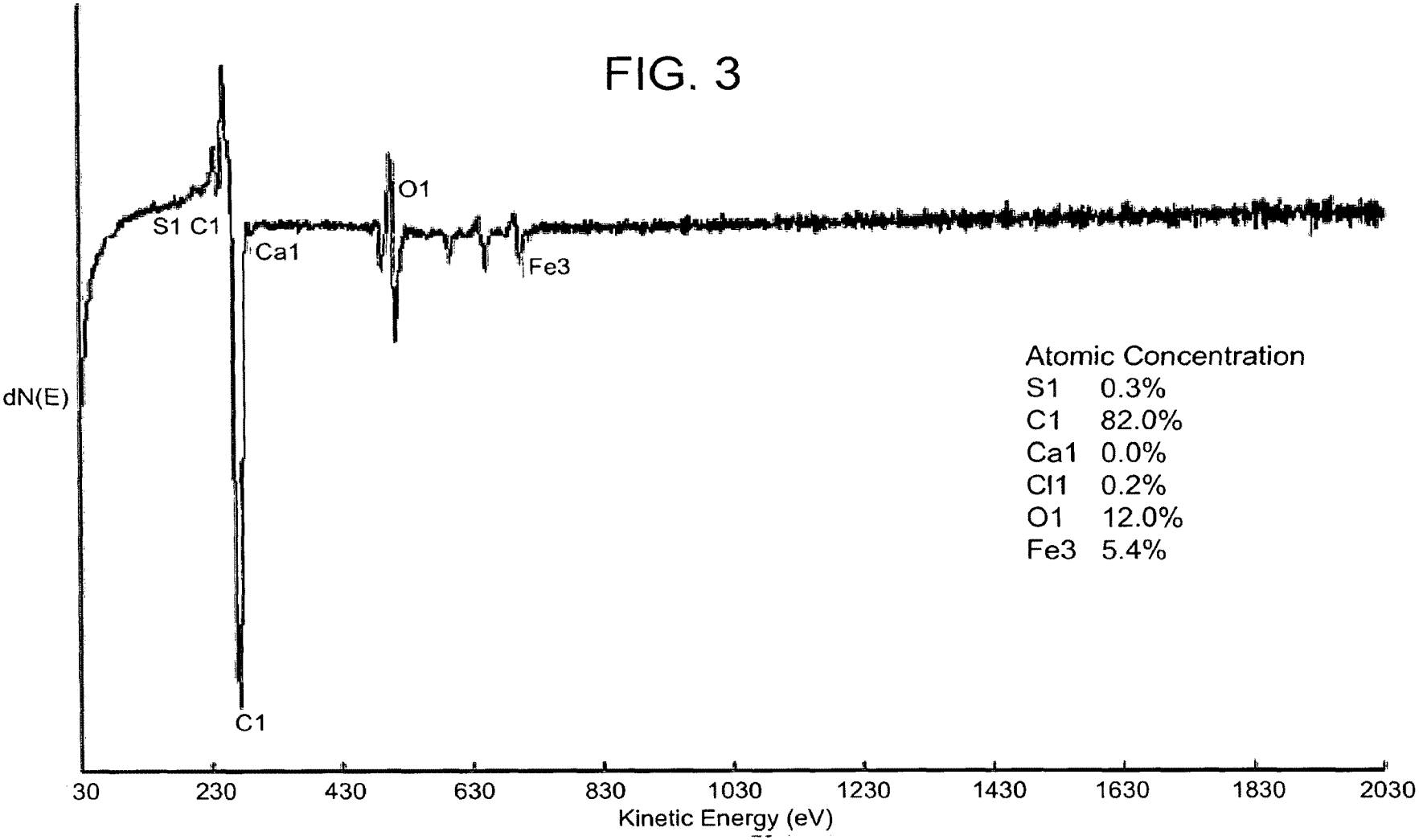
FIG. 3 is a graphic illustration of an Auger Electron Spectroscopy (AES) analysis profile of a complex scale layer after performing a pickling acid first conditioning process according to the present invention.

FIG. 3 is a graphic illustration of results of an Auger Electron Spectroscopy (AES) analysis profile of a complex scale layer on a sample of AHSS after performing a pickling acid first conditioning process at 102. The AES profile indicates a surface carbon concentration of over eighty (80) percent by weight, more particularly 82.0%, 0.3% silicon, no calcium (0.0%), 0.2% chlorine, 12% oxygen and 5.4% iron.

This remaining surface layer of mainly carbon, in conjunction with the underlying alloy-rich oxide layer, defines an inhibiting or physical barrier to continued acid pickling progress in acid-only pickling. The carbon physical barrier in conjunction with the alloy oxide chemical resistance may explain the poor pickling kinetics and the need to drastically reduce conventional hot band hydrochloric acid line speeds to successfully condition the scale layer on AHSS strips via prior art processes.

However, this remaining surface layer is also porous, due to the removal of the iron oxides in the pickling process, which enables the aqueous alkali salt solution disposed onto it at 104 to pass through the outer surface of the scale layer and enter into and engage underlying alloy oxides that remain disposed within the scale layer after the pickling at 102.

In one aspect where the first conditioning process at 102 is a first acidic pickling pretreatment, the application of the aqueous alkali salt solution at 104 is carried out by applying aqueous solutions (of varying concentrations) to dry pre-pickled steel surfaces, subsequent to a water rinse step. The coated metal strip is then heated to a final temperature of about 500° F. to 600° F. and then direct water quenched. Some aspects reach 600° F. in order to ensure that excess water within the aqueous alkali salt solution is driven off and that the salt is melted to a point sufficient to wet the alloy oxides and produce desired levels of conditioning.

In some aspects, incidental oils are removed from the steel surface via a drying process, and in some embodiments also a subsequent heating process, after the first conditioning process at 102 and prior to application of the aqueous alkali salt solution at 104. This ensures good and satisfactory wetting of the surface by the aqueous alkali salt solution. Where the drying step uses forced air or other apparatuses that do not remove incidental oils from the surface, a subsequent heating apparatus heats the metal surface to volatize any residual oils. Removal of incidental oils may also be accomplished by the water rinse where the first conditioning process at 102 is pickling, in some examples by adding a surfactant to the water, or via some other additional step.

Surfactant may also be incorporated into the aqueous alkali salt solution disposed at 104, to enhance spread across and wettability of the surface.

Figure 4:
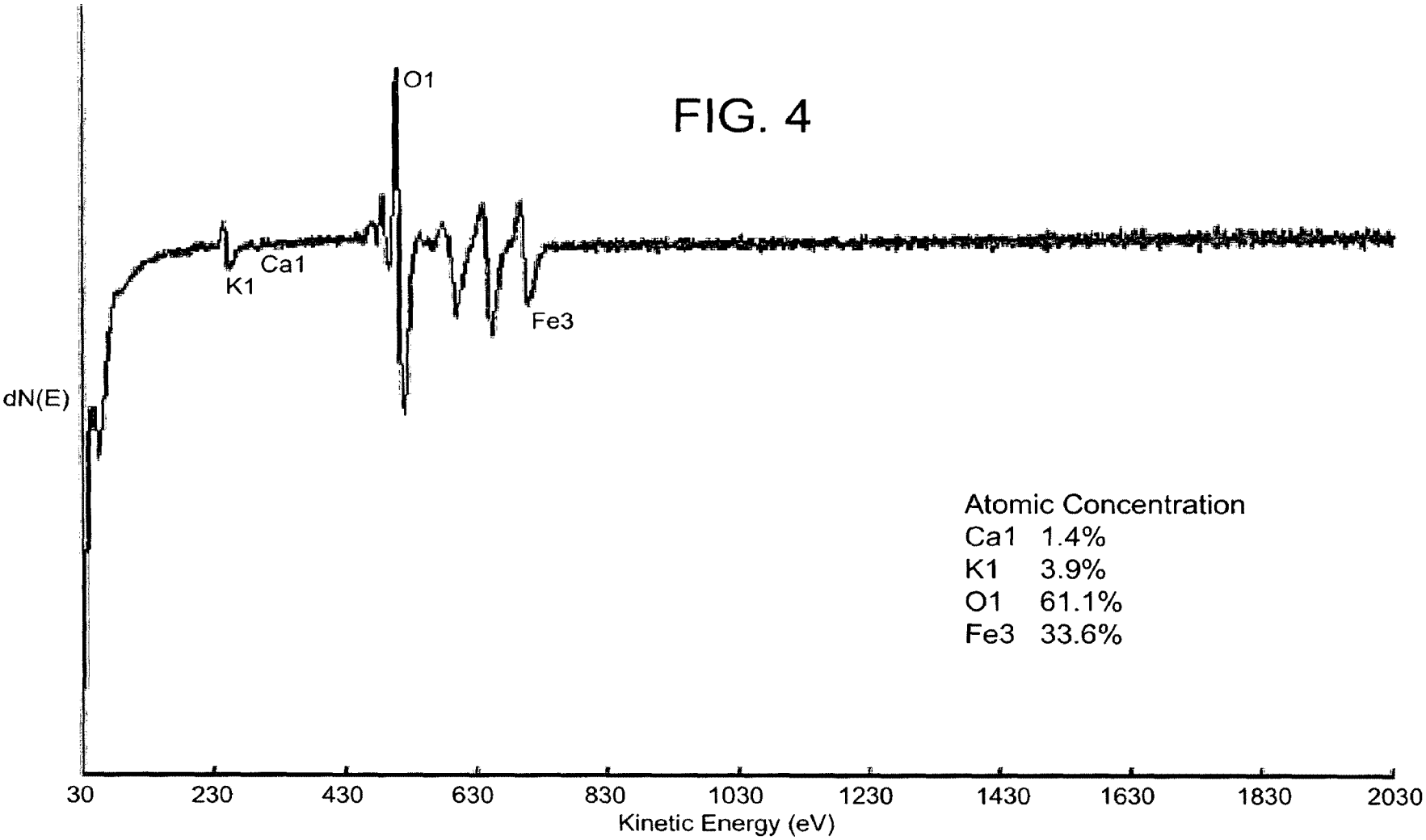
FIG. 4 is a graphic illustration of an Auger Electron Spectroscopy (AES) analysis profile of a scale layer remaining after performing a conditioning process with the aqueous alkali salt solution according to the present invention on the scale layer of the profile of FIG. 3.

The molten salt chemistries utilized in aspects of the present invention at steps 104-106-108 are based on alkali hydroxides, with additives that may be varied as necessary depending on the specific alloying elements present in the scale layer to promote desired amounts of oxidation, dissolution, etc. FIG. 4 is a graphic illustration of results of an AES profile of a scale layer remaining on a sample of AHSS after performing the conditioning process with the aqueous alkali salt solution at 104-106-108, and more particularly as performed on the scale layer profile of FIG. 3. The surface layer of 80% carbon has been oxidized to generate carbon dioxide, with no remainder (0.0%) present in the profile of FIG. 4. The profile also shows 1.45% calcium, 3.9% potassium, 61.1% oxygen and 33.6% iron.

It is noted that auger electron spectroscopy is capable of detecting many elements (excepting hydrogen and helium) within a nominal detection limit, for example of about 0.1%, but wherein spectral interferences may prohibit the detection of some elements in relatively low concentrations. The sampling volume of the measurements depicted in FIGS. 3 and 4 have a depth of about 10 nanometers (nm) and an analysis area of about 50 microns (μm) in diameter. The quantification method assumes that the sampling volume is homogeneous, wherein tables of relative elemental compositions are provided as a means to compare similar samples and to identify contaminants Accurate quantification of data is achieved through the use of reference materials of similar composition to an unknown sample, wherein compositional profiles (also called Sputter Depth Profiles (SDP)) may be obtained by combining Auger analysis with simultaneous sputter etching (for example, with a 4.0 keV Ar+ ion beam). Depth scales are reported on a relative scale in FIGS. 3 and 4 as elements and compounds sputter at different rates. Thicknesses indicated for multilayer profiles are based on a single sputter rate. It is noted that sputter etching can cause apparent compositional changes in multi-element systems. All elements have different sputter rates, thus "differential sputtering" can deplete the film of one or more of the constituent elements.

Oxidizing molten salt (enabled by atmospheric oxygen absorption, or by additions of chemically-bound oxygen via as alkali nitrates, or both) in the molten salt (1) forms higher valence metal compounds from manganese and other alloying metals then (2) reacts with molten alkalis such as sodium and potassium hydroxide to form salt and water soluble alkali salts such as sodium/potassium manganates and silicates. If aluminum is present, the formation of alkali aluminates is also probable.

Heating methods at 106 include conventional radiant heat, which may limit combustion products allowed and convert hydroxyl ions (OH—) to carbonate (CO3 2-) from the carbon dioxide (CO2) formed during combustion. Some aspects use induction heating, which enables a more rapid first stage heat-up relative to radiant techniques, followed by a conventional radiant second stage holding zone for the remainder of a desired conditioning period. A simple insulated chamber after the heating zone to maintain strip temperature may also be adequate to complete the conditioning action.

As AHSS is iron based, the use of induction heat is efficient and enables large energy savings over radiant and other approaches used to reheat non-carbon steels (ovens, etc.). Aspects using induction heating require only several seconds to heat the metal surface to the required conditioning temperature, and in one example five (5) seconds are sufficient. With advanced induction systems, it is possible to only heat the very surfaces of the steel strip where the reactions take place, saving time and energy as compared to through-heating the strip. This may be achieved quickly and easily at conventional pickle speeds of 200 to 300 meters/second or more, and therefore aspects of the present invention enable incorporation of this step within the time parameters of existing equipment installations, providing this conditioning step without negatively impacting throughput requirements within steel production and finishing facilities.

As noted above, heating the disposed solution at 106 transitions the form of the disposed alkali salts from an initial water solution state to a very concentrated water solution state, then to a super hydrated semi-molten condition, and lastly to an anhydrous molten state. The transition from aqueous chemical solution to fused salt via heating in the presence of the solution water also disposed on the scale layer enhances reaction with alloy elements and dissolving of the oxidation products, enabling the removal of conditioned alloy elements within the scale layer via the rinsing step at 110 that are otherwise not removed from the metal surface via conventional anhydrous molten salt bath processes utilized in the prior art.

Illustrative but not limiting or exhaustive examples of refractory oxide reaction products generated from oxide scale constituents via the molten salt scale conditioning process of steps 104-106-108 include: alkali silicate from silicon dioxide; alkali manganate from manganese dioxide; alkali aluminate from aluminum oxide; alkali molybdate from molybdenum oxide; and alkali chromate from chromium oxide. These alkali salt reaction products are soluble in the molten salt, in subsequent water rinses, or both.

However, while alkali aluminate forms readily in reaction with the molten alkali salt, such as in a conventional anhydrous molten salt bath, it is not salt soluble. Thus, it is not dissolved into conventional baths but instead remains on the surface of the conditioned metal, essentially forming a passive (or passivation) layer. In contrast, in aspects of the present invention, water present within the disposed solution during its transition to the anhydrous state via the heating at 106 allows the alkali aluminate to go into solution, and thereby keep the conditioning process progressing, as well as dissolving other metallic oxides that do not dissolve in conventional salt conditioning baths.

After salt scale conditioning and water rinsing, a thin, uniform, easily-removed iron oxide film remains on the advanced high strength steel surface that exhibits good reactivity with, and ready accessibility to, pickling acids. Thus, the oxide film is easily removed by hydrochloric acid pickling at 112. Complete residual scale removal is readily accomplished at normal hot band pickling speeds, in some examples after ten (10) seconds of residence of the pickle acid on the metal product surface, as the physical and chemical impediments to conventional hydrochloric acids have been mitigated, by execution of the sequence of previous steps 102-110.

Experimental results from application of the aspects described above confirm the formation of alkali manganate and alkali silicate. Test panels were processed through steps 102-108. The salt residue on the samples was rinsed at 110 and the rinse water collected. In one instance, characteristic coloration developed in the rinse water indicative of alkaline manganate. In another test, rinse water collected and analyzed by inductively coupled plasma/optical emission spectroscopy (ICP/OES) showed positive results for silicon and manganese.

In one aspect, the aqueous alkali salt solution has an anhydrous molten chemistry of essentially 85% by weight potassium hydroxide (KOH), 7.5% sodium nitrate ($NaNO_3$) and 7.5% sodium chloride (NaCl). The term "essentially" will be understood in this context to convey that any remainder reducing or otherwise reactive components will be of a quantity fundamentally insufficient to react with the scale layer oxides or the underlying metal surface layer.

One formulation of the aqueous alkali salt solution comprises 33% by weight of a 90% potassium hydroxide flake, 2.60% of sodium nitrate, 2.60% sodium chloride, 3.30% water from the flake potassium hydroxide, and 58.50% of additional water, the solution comprising about 35% by weight dissolved solids.

Another formulation of the aqueous alkali salt solution uses 45% liquid potassium hydroxide as a constituent to produce 29.7% by weight potassium hydroxide on a dry basis, 2.60% sodium nitrate, 2.60% sodium chloride, 36.4% water (from the 45% liquid potassium hydroxide, to which is added 28.6% of additional water. This solution comprises about 29.7495% by weight dissolved potassium hydroxide solids (85% of total weight of solids), 2.625% of sodium nitrate (7.5% of total weight of solids), and 2.625% sodium chloride (7.5% of total weight of solids), for a total solids weight of 34.9995% of the solution weight.

A fractional percentage of an appropriate alkali stable surfactant (less than 0.1% of total weight in a wet aqueous solution basis) may be added to the above aqueous alkali salt solutions. Examples include Rhodia Mirataine ASC, and Air Products SF-5 Surfactant, and still others will be apparent to one skilled in the art. Thus, to 100 grams of the aqueous alkali salt solution about 0.1 grams of the surfactant are added.

It should be noted that while the embodiments discussed thus far use sodium or potassium cations as alkaline caustic conditioning agents, alternative embodiment mixtures may utilize different cations, and that associated descaling parameters and effects are primarily dependent upon the particular anion present.

The performance of compounds used as descaling agents may be easy to judge visually, wherein ineffectiveness of conditioning may be confirmed by subsequent pickling after which an original scale would be present in substantially unchanged form. Evaluation criteria for selecting appropriate conditioning compositions and their applied stoichiometric amounts may include appearance of conditioned oxide with regard, e.g., to color, opacity, weight loss and uniformity; ease of removal of delaminated oxide layers by mechanical bending, brushing, rinsing, wiping or subsequent acid pickling; and final appearance of a descaled metal surface with regard, e.g., to color, brightness, uniformity, smoothness and freedom from residual oxide. It is to be understood that these several criteria can vary independently in degree and direction one from another, so that there is a certain subjective element to the quantitative assignment of detrimental or beneficial effects of any descaling agents or additives.

Figure 2:
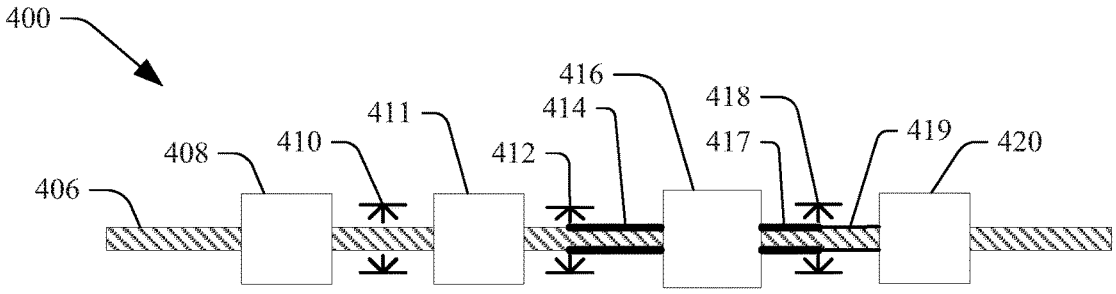
FIG. 2 is a diagrammatic representation view of a process or system according to the present invention for treating and removing a layer of scale comprising iron oxide and alloying element oxides that is formed on an advanced high strength metal surface.

Aspects of the present invention combine three or more different and distinct scale conditioning processes in a novel and specific multi-step sequence that efficiently and satisfactorily conditions and removes scales comprising mixtures of iron and alloy oxides from the surface of hot rolled advanced high strength steels. FIG. 2 illustrates a somewhat diagrammatic representation of a process or system 400 for scale conditioning section according to the process and method of FIG. 1 as described above.

A strip of AHSS steel 406 is drawn through a first conditioning process apparatus 408 that conditions the complex scale layer formed thereon (via a mechanical or pickling process) to compromise a structural integrity of the iron oxide within the complex scale layer and thereby expose the residual alloy oxide(s) to chemical engagement via disposition onto the scale layer, either through the compromised structural integrity of the iron oxide and/or via removal of iron oxide components from the scale layer. The strip 406 may have scale formed on both the top and bottom surfaces, and accordingly the present example of the process/system 400 depicts elements that performs conditioning of both the top and bottom surfaces, though this is optional, and in some examples only one of the top and bottom surfaces are conditioned.

Where the first conditioning process apparatus 408 is a pickling process, a water rinsing station 410 rinses off the surface of the strip 406 after the pickling process, and a drying apparatus 411 removes moisture and incidental oils from the steel surface. In some embodiments, the drying apparatus 411 wipes the surface with an absorbent material that pulls moisture from the surface. In some embodiments, the drying apparatus 411 includes a separate heating apparatus (not shown) that heats the metal strip surface 406 to volatize any incidental oils remaining after the rinsing 410 and drying processes steps, for example where the drying apparatus 411 incorporates forced air or other elements that dry the metal strip 406 by eliminating water moisture from the surface without also removing any incidental oils.

A salt solution disposition station 412 disposes a layer 414 of an aqueous alkali salt solution according to the present invention as described above onto the scale layer on the surface of the strip 406 that has been conditioned via the first conditioning process, wherein the disposed aqueous alkali salt solution layer 414 engages with the residual alloy oxide(s) exposed to chemical engagement through the compromised structural integrity of the iron oxide, or as exposed by removal of the iron oxide components from the scale layer. Formation of the layer 414 of aqueous alkali salt solution by the disposition station 412 may be achieved by a variety of ways, i.e., through any method or system that forms a uniform coating or complete wetting of the surface of the AHSS strip 406 with the conditioning solution. Illustrative but not exhaustive examples of disposition station 412 elements and apparatuses include dunker roller or roll/roller coaters as well as spray nozzles, curtain coaters and applicators, immersion methods and systems or combinations thereof.

While the diagram illustrates a line of process in a horizontal plane, it is not the intention to limit the line configuration to a single plane. Certain elements, including the water rinse heads 410 or solution applicators 412, may be easily configured in a vertical plane followed by other vertical or horizontal or angled elements as necessary to carry out the process and/or accommodate physical line constraints.

A heating station or apparatus 416 heats the surface of the strip 406 to bring the disposed aqueous alkali salt solution 414 to at least 288 degrees Celsius (550 degrees Fahrenheit), melting alkali salt within the disposed aqueous alkali salt solution into a quasi-molten form, wherein water and the quasi molten form of the alkali salt(s) within the disposed aqueous alkali salt solution react with (oxidize) each of the alloy oxide(s) to form respective water soluble alkali alloy compound(s), as described above.

A water rinsing station 418 then rinses the surface of the AHSS strip 406 product with water, the water dissolving water soluble alkali alloy compound(s) and rinsing dissolved compound(s) within a resultant layer 417 (produced by the alkali conditioning via the heating process) from the surface of the AHSS strip 406, leaving a film of iron oxide 419 on the surface of the AHSS strip 406.

A final pickling process 420 pickles and thereby removes the iron oxide film layer 419 from the surface of the AHSS strip 406.

It will be understood that each of the process components of the sequence depicted within FIG. 2 may be separately implemented in different locations and within different compatible steel production, pickle line and alkali salt conditioning equipment lines and locations that may be remote from one another. For example, after implementing the first conditioning process 408, the steel strip 406 may be coiled by a coiling apparatus (not shown) and transported to another location, where it is uncoiled by an uncoiling apparatus (not shown) and subjected to the alkali condition solution deposition by apparatus 412 and heating by heating station 416, and wherein it may again be similarly coiled, transported, uncoiled prior to the final conditioning by station 420 which may be located remotely at yet another different location.

Accordingly, each of the different processes of the sequence 400 may be integrated in component fashion into a variety of different and existing steel production, pickling and alkali salt conditioning lines, or implemented off-line, into different scale conditioning processes. Each process or incorporating line may also be selected as a function of the complex oxide scale properties, as appropriate to provide reactive engagement of the different types and forms of complex oxide scales that may be formed as a function of different forming temperatures and alloy compositions, as discussed above. Aspects thereby enable full compatibility with existing pickling and alkali salt conditioning lines, thereby leveraging existing infrastructure investments, pickling processes, acid management structures, etc.

While the present invention has been illustrated by the description of the embodiments thereof, and while these embodiments have been described in considerable detail, it is not the intention to restrict or in any way limit the scope of the appended claims to such detail. For example, while discussions above may focus primarily on metals in strip form, the applicability and value of the present invention may be useful for conditioning oxide surfaces or scale in various shapes, geometries, or assemblies other than metal strip, and it is not intended to limit the benefits to only metal strip. Additional advantages and modifications may readily appear to those skilled in the art. Therefore, the invention, in its broadest aspects, is not limited to the specific details, the representative apparatus, or the illustrative examples shown and described. Accordingly, departures may be made from such details without departing from the spirit or scope of the applicants' general inventive concept.

Units which are used in this specification and which are not in accordance with the metric system may be converted to the metric system with the aid of the following formulas: 1° C.=(° F.-32) 5/9; 1 inch=$2.54\times10^{-2}$ m; and 1 F.p.m. (foot per minute)=$5.08\times10^{-2}$ m/sec.

What is claimed is:

1. A system, comprising:

a first conditioning process apparatus that compromises a structural integrity of iron oxide within a scale layer that is formed on a surface of an advanced high strength steel product via reaction with oxygen during a hot rolling process, wherein the advanced high strength steel product comprises at least two (2) percent by weight of alloy and the scale layer comprises alloy oxide formed by oxidation of the alloy and the iron oxide, and wherein the first conditioning process apparatus compromises the structural integrity of iron oxide within the scale layer to expose the alloy oxide to chemical engagement via disposition onto the scale layer and through the compromised structural integrity of the iron oxide;

a salt solution disposition station that disposes onto the scale layer conditioned via the first conditioning process apparatus a layer of an aqueous alkali salt solution, thereby into engagement with the alloy oxide that is exposed to chemical engagement;

a heating apparatus that heats the disposed aqueous alkali salt solution to at least 288 degrees Celsius (550 degrees Fahrenheit), said heating transforming at least one alkali salt within the layer of disposed aqueous alkali salt solution into a quasi-molten form, and the quasi molten form of the at least one alkali salt and water within the disposed aqueous alkali salt solution oxidizes the alloy oxide to form a resultant layer comprising at least one water soluble alkali alloy compound on the surface of the advanced high strength steel product, wherein an anhydrous form of the molten at least one alkali salt comprises, by weight:

85% potassium hydroxide (KOH);

7.5% sodium nitrate (NaNO3); and 7.5% sodium chloride (NaCl);

a water rinsing station that rinses the surface of the advanced high strength steel product with water, the water dissolving the at least one water soluble alkali alloy compound within the resultant layer and rinsing the dissolved the at least one water soluble alkali alloy compound from the surface of the advanced high strength steel product, the rinsing thereby leaving a film of iron oxide on the surface of the advanced high strength steel product; and a final pickling process apparatus that pickles the surface of the advanced high strength steel product via a final pickling process to remove the iron oxide film layer from the surface of the advanced high strength steel product.

2. The system of claim 1, wherein the first conditioning process apparatus is a-mechanical scale breaking process that generates micro-cracks in the oxide scale to provide fluid pathways to the scale-metal interface and effectively exposes the alloy oxide to chemical engagement via disposition onto the scale layer.

3. The system of claim 1, wherein the first conditioning process apparatus is a mechanical abrasive scale removal process that exposes the alloy oxide to chemical engagement via disposition onto the scale layer via removal of iron oxide components from the scale layer.

4. The system of claim 1, wherein the first conditioning process apparatus is a first pickling process that comprises compromising the structural integrity of the iron oxide within the scale layer to thereby expose the alloy oxide to chemical engagement via disposition onto the scale layer and through the compromised structural integrity of the iron oxide, by disposing a first pickling acid onto the scale layer, wherein the disposed first pickling acid reacts with the iron oxide within the scale layer to form first reaction products comprising water, a layer of elemental carbon, and at least one of an iron sulfate and an iron chloride, wherein the first pickling acid comprises at least one of a hydrochloric acid and a sulfuric acid; and the system further comprising:

another water rinsing apparatus that rinses the surface of the advanced high strength steel product to remove the water and the at least one of an iron sulfate and an iron chloride of the first reaction products from the surface of the advanced high strength steel product; and a drying apparatus that removes moisture and incidental oils from the surface of the advanced high strength steel product, thereby forming a porous outer layer comprising the elemental carbon on an outer surface of the scale layer that enables the aqueous alkali salt solution disposed onto the outer surface of the scale layer to pass through the outer surface of the scale layer and engage underlying alloy oxides disposed within the scale layer, wherein the heated, disposed aqueous alkali salt solution oxidizes the porous outer layer of the elemental carbon to generate carbon dioxide; and wherein the drying apparatus heats the surface of the advanced high strength steel product to volatize the incidental oils.

5. The system of claim 4, wherein:

the disposed aqueous alkali salt solution transitions from an initial water solution state to a very concentrated water solution state, then to a super hydrated semi-molten condition, and lastly to an anhydrous molten state, during heating of the disposed aqueous alkali salt solution to at least 288 degrees Celsius (550 degrees Fahrenheit) by the heating apparatus;

wherein the water within the disposed aqueous alkali salt solution dissolves the at least one water soluble alkali alloy compound formed by the step of oxidizing the alloy oxide within the scale layer during the transitioning of the disposed aqueous alkali salt solution to the anhydrous molten state;

wherein the final pickling process apparatus disposes a second pickling acid onto the surface of the advanced high strength steel product; and wherein the disposed second pickling acid dissolves and removes from the surface of the advanced high strength steel the iron oxide remaining after the first conditioning process.

6. The system of claim 5, wherein the heating apparatus heats the disposed aqueous alkali salt solution to melt at least one alkali salt within the disposed aqueous alkali salt solution into the molten form via heating the surface of the advanced high strength steel product; and wherein the heating apparatus heats the surface of the advanced high strength steel product to a temperature of at least 288 degrees Celsius (550 degrees Fahrenheit) for at least five seconds.

7. The system of claim 6, wherein the heating apparatus heats the surface of the advanced high strength steel product to a temperature of 600 degrees Fahrenheit (315 degrees Celsius) for at least five seconds.

8. The system of claim 1, wherein the aqueous alkali salt solution comprises about 35% by weight dissolved solids, and by weight:

33% of a 90% potassium hydroxide flake;

2.60% of sodium nitrate;

2.60% of sodium chloride;

3.30% water from the flake potassium hydroxide; and 58.50% of additional water.

9. The system of claim 8, wherein the aqueous alkali salt solution comprises an alkali stable surfactant, a weight of the alkali stable surfactant comprising between 0.01% and 1% of a total weight of the aqueous alkali salt solution.

10. A method for treating and removing a layer of scale comprising iron oxide and alloying elements oxides that is formed on an advanced high strength metal surface, the method comprising:

conditioning, via a first conditioning process, a scale layer that is formed on a surface of an advanced high strength steel product via reaction with oxygen during a hot rolling process, wherein the advanced high strength steel product comprises at least two (2) percent by weight of alloy, and wherein the scale layer comprises iron oxide and alloy oxide that is formed by oxidation of the alloy, and wherein the conditioning via the first conditioning process comprises at least one of compromising a structural integrity of the iron oxide within the scale layer to thereby expose the alloy oxide to chemical engagement via disposition onto the scale layer and through the compromised structural integrity of the iron oxide, and exposing the alloy oxide to chemical engagement via disposition onto the scale layer via removal of iron oxide components from the scale layer;

disposing onto the scale layer that is conditioned via the first conditioning process an aqueous alkali salt solution, and thereby into engagement with the alloy oxide that is exposed to chemical engagement;

heating the disposed aqueous alkali salt solution to at least 288 degrees Celsius (550 degrees Fahrenheit), said heating transforming at least one alkali salt within the disposed aqueous alkali salt solution into a quasi-molten form, wherein an anhydrous form of the molten at least one alkali salt comprises, by weight:

85% potassium hydroxide (KOH);

7.5% sodium nitrate (NaNO3); and 7.5% sodium chloride (NaCl);

oxidizing, via reaction with the quasi molten form of the at least one alkali salt and with water within the disposed aqueous alkali salt solution, the alloy oxide to form at least one water soluble alkali alloy compound;

rinsing with water the surface of the advanced high strength steel product, the water dissolving the at least one water soluble alkali alloy compound and rinsing the dissolved the at least one water soluble alkali alloy compound from the surface of the advanced high strength steel product, the rinsing thereby leaving a film of iron oxide on the surface of the advanced high strength steel product; and pickling the surface of the advanced high strength steel product via a final pickling process to remove the iron oxide film layer from the surface of the advanced high strength steel product.

11. The method of claim 10, wherein the first conditioning process is a mechanical scale breaking process that generates micro-cracks in the oxide scale to provide fluid pathways to the scale-metal interface and effectively exposes the alloy oxide to chemical engagement via disposition onto the scale layer.

12. The method of claim 10, wherein the first conditioning process is a mechanical abrasive scale removal process that exposes the alloy oxide to chemical engagement via disposition onto the scale layer via removal of iron oxide components from the scale layer.

13. The method of claim 10, wherein the first conditioning process is a first pickling process that comprises compromising the structural integrity of the iron oxide within the scale layer to thereby expose the alloy oxide to chemical engagement via disposition onto the scale layer and through the compromised structural integrity of the iron oxide, by:

disposing a first pickling acid onto the scale layer;

the disposed first pickling acid reacting with the iron oxide within the scale layer to form first reaction products comprising water, a layer of elemental carbon, and at least one of an iron sulfate and an iron chloride, wherein the first pickling acid comprises at least one of a hydrochloric acid and a sulfuric acid; and water rinsing the surface of the advanced high strength steel product to remove the water and the at least one of an iron sulfate and an iron chloride of the first reaction products from the surface of the advanced high strength steel product, thereby forming a porous outer layer comprising the elemental carbon on an outer surface of the scale layer that enables the aqueous alkali salt solution disposed onto the outer surface of the scale layer to pass through the outer surface of the scale layer and engage underlying alloy oxide disposed within the scale layer; and the method further comprising the heated, disposed aqueous alkali salt solution oxidizing the porous outer layer of the elemental carbon to generate carbon dioxide.

14. The method of claim 13, further comprising:

the disposed aqueous alkali salt solution transitioning from an initial water solution state to a very concentrated water solution state, then to a super hydrated semi-molten condition, and lastly to an anhydrous molten state, during the step of heating the disposed aqueous alkali salt solution to at least 288 degrees Celsius (550 degrees Fahrenheit); and the water within the disposed aqueous alkali salt solution dissolving the at least one water soluble alkali alloy compound formed by the step of oxidizing the alloy oxide within the scale layer during the transitioning of the disposed aqueous alkali salt solution to the anhydrous molten state.

15. The method of claim 14, wherein the step of pickling the surface of the advanced high strength steel product to remove the iron oxide film layer comprises:

disposing a second pickling acid onto the surface of the advanced high strength steel product;

the second pickling acid dissolving the layer of iron oxide remaining on the surface of the advanced high strength steel after the first conditioning process from the surface of the advanced high strength steel.

16. The method of claim 14, wherein the advanced high strength steel product comprises a plurality of different alloy elements, and the plurality of different alloy elements comprises at least two of silicon, manganese, aluminum, molybdenum and chromium;

wherein the scale layer formed on the surface of the advanced high strength steel product comprises a plurality of different alloy oxides, and the plurality of different alloy oxides comprises at least two of silicon dioxide, manganese dioxide, aluminum oxide, molybdenum oxide and chromium oxide; and wherein the at least one water soluble alkali alloy compound comprises a plurality of different alkali alloy compounds, and the plurality of different alkali alloy compounds comprises at least two of alkali silicate formed from the silicon dioxide, alkali manganate formed from the manganese dioxide, alkali aluminate formed from the aluminum oxide, alkali molybdate formed from the molybdenum oxide, and alkali chromate formed from the chromium oxide.

17. The method of claim 14, wherein the step of heating the disposed aqueous alkali salt solution to melt at least one alkali salt within the disposed aqueous alkali salt solution into the molten form comprises heating of the surface of the advanced high strength steel product.

18. The method of claim 17, further comprising heating the surface of the advanced high strength steel product to a temperature of at least 288 degrees Celsius (550 degrees Fahrenheit) for at least five seconds.

19. The method of claim 18, further comprising heating the surface of the advanced high strength steel product to a temperature of 600 degrees Fahrenheit (315 degrees Celsius) for at least five seconds.

20. The method of claim 10, wherein the aqueous alkali salt solution comprises about 35% by weight dissolved solids, and by weight: 33% of a 90% potassium hydroxide flake; 2.60% of sodium nitrate; 2.60% of sodium chloride; 3.30% water from the flake potassium hydroxide; and 58.50% of additional water.

21. The method of claim 20, wherein an alkali stable surfactant is added to the aqueous alkali salt solution, the weight of the added surfactant comprising between 0.01% and 1% of a total weight of the aqueous alkali salt solution.

* * * * *